US010897669B2

(12) United States Patent
Ring et al.

(10) Patent No.: US 10,897,669 B2
(45) Date of Patent: Jan. 19, 2021

(54) TWO LAYER MICROPHONE PROTECTION

(71) Applicant: BOSE CORPORATION, Framingham, MA (US)

(72) Inventors: Martin David Ring, Ashland, MA (US); David-Michael Lozupone, Westborough, MA (US); Edwin C. Johnson, Jr., Hopkinton, MA (US); David Glenn Meeker, Marlborough, MA (US); Michael Ciufo, Medway, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/102,163

(22) Filed: Aug. 13, 2018

(65) Prior Publication Data

US 2020/0053458 A1 Feb. 13, 2020

(51) Int. Cl.
*H04R 3/00* (2006.01)
*H04R 1/08* (2006.01)
(Continued)

(52) U.S. Cl.
CPC ..... *H04R 3/007* (2013.01); *H04R 1/083* (2013.01); *H04R 1/10* (2013.01); *H04R 3/04* (2013.01); *H04R 2410/07* (2013.01)

(58) Field of Classification Search
CPC ..... H04R 3/007; H04R 1/083; H04R 1/10; H04R 3/04; H04R 2410/07; H04R 19/04;
(Continued)

(56) References Cited

U.S. PATENT DOCUMENTS 3,876,843 A * 4/1975 Moen ..... H04R 1/38 381/313
2005/0207605 A1* 9/2005 Dehe ..... H04R 19/04 381/369

(Continued)

FOREIGN PATENT DOCUMENTS

CN 205213006 U 5/2016
CN 207638827 U 7/2018

OTHER PUBLICATIONS

Invitation to Pay Additional Fees and Partial International Search Report for International Application No. PCT/US2019/046377 dated Nov. 13, 2019.

(Continued)

*Primary Examiner* — Norman Yu
(74) *Attorney, Agent, or Firm* — Patterson + Sheridan, LLP

(57) ABSTRACT

Aspects of the present disclosure provide multi-layer microphone protection for any apparatus that captures sound. The apparatus includes an enclosure defining a first cavity. A microphone element is coupled to the first cavity. The microphone element comprises a microphone sensor and a microphone cavity. A first, outer protective layer is disposed at an outer end of the first cavity, closer to the external environment. A second, inner protective layer is disposed between an inner end of the first cavity and the microphone element. The second, inner protective layer may protect the microphone sensor from particles or liquids that may have passed through the first protective layer. The first and second layers may have different acoustic properties.

19 Claims, 6 Drawing Sheets

(51) Int. Cl.
*H04R 1/10* (2006.01)
*H04R 3/04* (2006.01)

(58) Field of Classification Search
CPC .... H04R 1/086; H04R 2499/11; H04R 17/02; H04R 1/1008; H04R 1/105; H04R 1/38; H04R 1/406; H04R 2201/003
USPC ..... 381/355, 26, 309, 74, 91, 112–115, 122, 381/345–346, 369
See application file for complete search history.

(56) References Cited

U.S. PATENT DOCUMENTS

| | | | | |
|---|---|---|---|---|
| 2008/0283988 | A1* | 11/2008 | Huang | H04R 19/005 257/680 |
| 2010/0322452 | A1* | 12/2010 | Ladabaum | H04R 25/656 381/375 |
| 2011/0013799 | A1* | 1/2011 | Fang | H04R 1/086 381/355 |
| 2012/0250897 | A1* | 10/2012 | Michel | H04R 1/406 381/111 |
| 2014/0064542 | A1* | 3/2014 | Bright | H04R 1/086 381/359 |
| 2016/0037243 | A1* | 2/2016 | Lippert | H04R 1/023 381/166 |

OTHER PUBLICATIONS

International Search Report and Written Opinion for International Application No. PCT/US2019/046377 dated Jan. 14, 2020.

* cited by examiner

TWO LAYER MICROPHONE PROTECTION

BACKGROUND

Aspects of the present disclosure generally relate to a multi-layer microphone protection for a device that captures sound.

Headphones and speakers can include any number of microphones. The microphones may be used for, but would not be limited to, one or more simultaneous or asynchronous conditions of the following uses: active noise cancellation, noise reduction, and/or communication. Electret condenser microphones (ECMs) are robust; therefore, devices using ECMs are generally designed to protect against gross negligence of a user. Micro Electro-Mechanical System (MEMS) microphones, which may be referred to as microphone chips or silicon MEMS microphones, are smaller and more fragile than ECMs. MEMS microphones are more sensitive to negligence as well as liquid, dust, and debris. Effective protection for any type of microphone or sensor, including small, fragile, or sensitive microphones or sensors is desired.

SUMMARY

All examples and features motioned herein can be combined in any technically possible manner.

Certain aspects provide an apparatus. The apparatus comprises an enclosure comprising a first cavity, a microphone element coupled to the first cavity, the microphone element comprising a microphone sensor and a microphone cavity, a first outer protective layer disposed at an outer end of the first cavity, and a second inner protective layer disposed between an inner end of the first cavity and the microphone element.

According to an aspect, the first outer protective layer is associated with a first acoustic impedance and the second inner protective layer is associated with a second acoustic impedance, wherein the first and second acoustic impedances are different. According to an aspect, an acoustic impedance associated with the first outer protective layer is lower than an acoustic impedance of the second inner protective layer.

According to an aspect, an average pore size of the first outer protective layer is larger than an average pore size of the second inner protective layer.

According to an aspect, an acoustic impedance in rayls associated with the first outer protective layer is lower than an acoustic impedance in rayls associated with the second inner protective layer.

According to an aspect, the microphone element comprises a top-port microphone element and the second inner protective layer is in contact with a cover plate of the microphone element.

According to an aspect, the microphone element comprises a bottom-port microphone element and the second inner protective layer is disposed between, and in contact with, the inner end of the first cavity and a substrate of the bottom-port microphone element. According to an aspect, the second inner protective layer is one of press-fit or adhered to the substrate.

According to an aspect, the apparatus further comprises a perforated layer in contact with and disposed along an external surface of the first outer protective layer.

According to an aspect, the first outer protective layer and the second inner protective layer comprise different shapes and sizes. According to an aspect, the first outer protective layer covers a larger surface than the second inner protective layer.

According to an aspect, at least one of the first outer protective layer and the second inner protective layer comprises a hydrophobic coating.

According to an aspect, the apparatus comprises one of an in-ear headphone, an around-ear headphone, on-ear headphone, or a speaker.

Certain aspects provide an apparatus comprising an enclosure comprising a first cavity, a microphone assembly coupled to the first cavity, the microphone assembly comprising an array of microphone elements, a first protective layer disposed at an outer end of the first cavity, and a second protective layer disposed between an inner end of the first cavity and each microphone sensor in the array of microphone elements.

According to an aspect, the first protective layer is associated with a first acoustic impedance and the second protective layer is associated with a second acoustic impedance, wherein the first and second acoustic impedances are different.

According to an aspect, the first protective layer is associated with a larger percent open area than the second protective layer.

According to an aspect, the array of microphone elements comprises an array of Micro Electro-Mechanical System (MEMS) microphone sensors.

According to an aspect, the outer end of the first cavity covers a larger surface area than the inner end of the first cavity.

According to an aspect, at least one of the first protective layer and the second protective layer comprises a material having hydrophobic properties.

According to an aspect, the second protective layer is one of adhered or press-fit to one of a cover plate of the microphone assembly and a circuit board in contact with the array of microphone elements.

Advantages of the multi-layer protection described herein will be apparent from the description and the claims.

DETAILED DESCRIPTION

Aspects of the present disclosure provide at least a two-layer (dual-layer) protection for at least one microphone in a device that captures sound. Example devices include a headphone, speaker, hearing assistance device, or built-in home device. Aspects and implementations disclosed herein may be applicable to a wide variety of speaker systems, such as wearable audio devices in various form factors. Unless specified otherwise, the term wearable audio device, as used in this document, includes headphones and various other types of personal audio devices such as head, shoulder or body-worn acoustic devices (e.g., audio eyeglasses or other head-mounted audio devices) that include one or more acoustic drivers to produce sound, with or without contacting the ears of a user. It should be noted that although specific implementations of speaker systems primarily serving the purpose of acoustically outputting audio are presented with some degree of detail, such presentations of specific implementations are intended to facilitate understanding through provision of examples and should not be taken as limiting either the scope of disclosure or the scope of claim coverage.

A headphone refers to a device that fits around, on, or in an ear and that radiates acoustic energy into the ear canal. Headphones are sometimes referred to as earphones, earpieces, headsets, earbuds, or sport headphones, and can be wired or wireless. A headphone includes an acoustic driver to transduce audio signals to acoustic energy. A headphone may include components of an active noise reduction (ANR) system. Headphones may also include one or more microphones for ANR, noise cancellation, or communication.

While some of the figures and descriptions following show a single headphone, a headphone may be a single stand-alone unit or one of a pair of headphones (each including one or more microphones), one for each ear. A headphone may be connected mechanically to another headphone, for example by a headband and/or by leads that conduct audio signals to an acoustic driver in the headphone. A headphone may include components for wirelessly receiving audio signals. While some figures and descriptions following show one or more headphones as an example audio device, the multi-layer microphone protection described herein also applies to other audio devices, such as speakers, home theater systems, telecom systems, built-on devices for a home, and wearable audio devices in various form factors (e.g., audio eyeglasses, hearing assistance devices, and other head, shoulder, or body worn audio devices that include one or more acoustic drivers to produce sound, with or without contacting the ears of a user).

Figure 1:
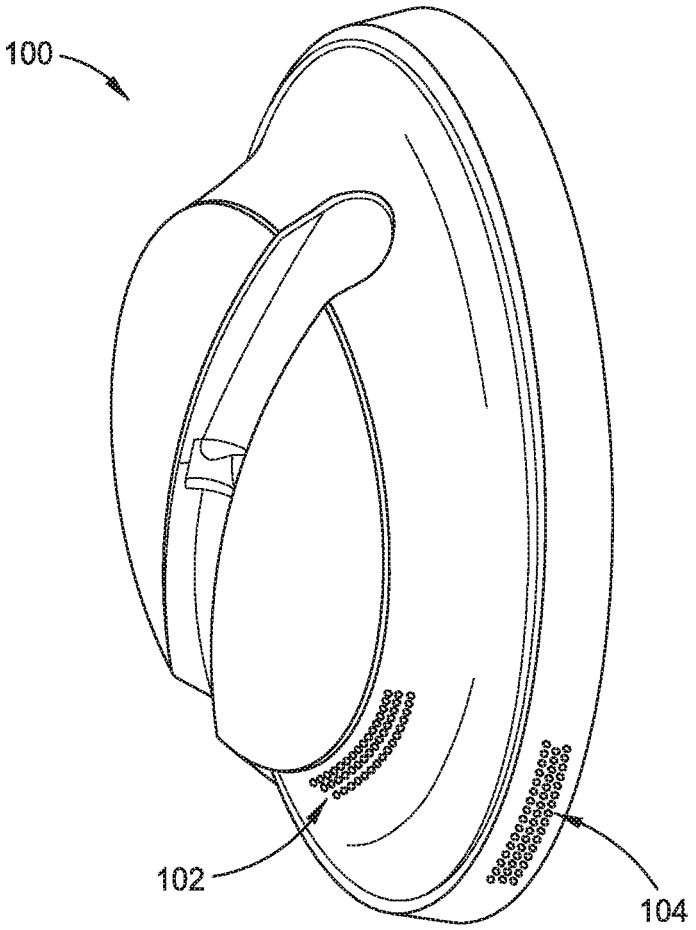
FIG. 1 illustrates an example headphone cover for one headphone of a headset.

FIG. 1 illustrates an example headphone cover 100 for one headphone of a headset. The headphone cover 100 includes a set of perforations 102, 104 at two locations. Each of the sets of perforations 102 and 104 on the headphone cover 100 is associated with a separate microphone element opening visible to the outside world. While two sets of perforations are illustrated, a headphone cover may include more than two or fewer than two sets of perforations.

Figure 2:
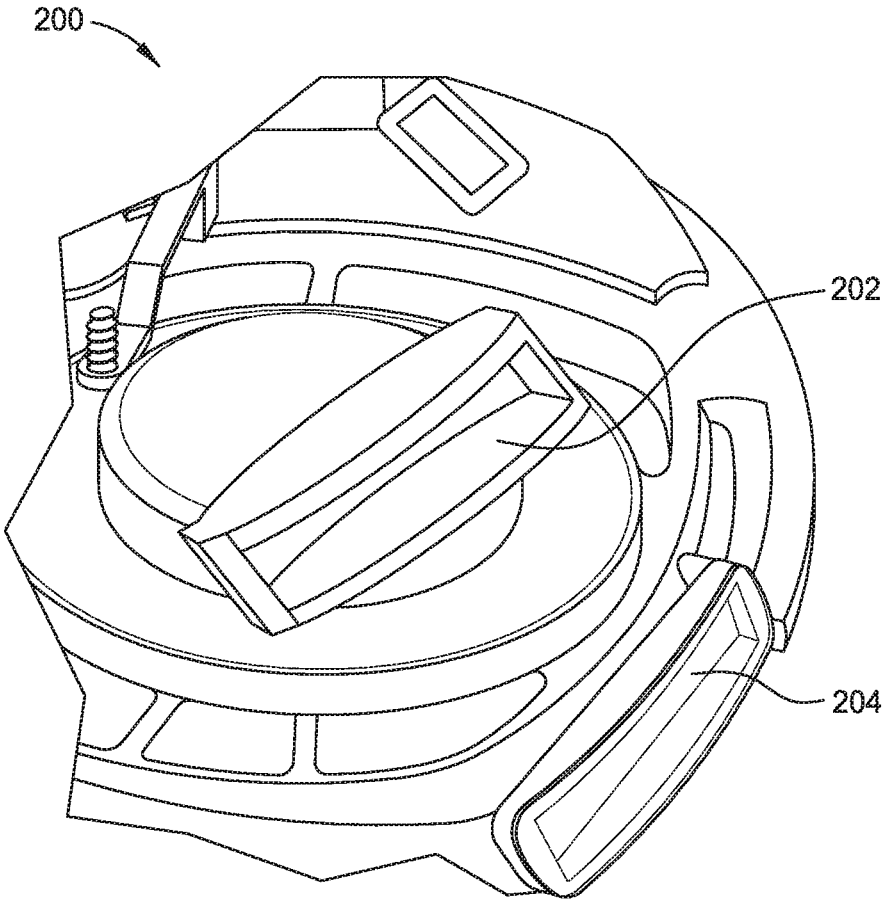
FIG. 2 illustrates an interior portion of a headphone after removal of a headphone cover.

FIG. 2 illustrates an interior portion of a headphone 200 after removal of a headphone cover such as the headphone cover 100 illustrated in FIG. 1. Two enclosures 202 and 204 are illustrated. Each enclosure defines a respective (first) cavity. The cavity of the enclosures is coupled to a respective microphone element (not illustrated). The microphone elements include a microphone sensor disposed in a microphone cavity.

According to current designs, a protective layer is disposed at an outer end of each enclosure 202 and 204. For example, a protective layer is positioned between each of the enclosures 202, 204 and the headphone cover 100 illustrated in FIG. 1 (not illustrated in FIG. 2). In an example, the protective layer is used for wind noise mitigation and protects the microphone sensor from particle ingress. In certain aspects, a perforated layer (such as the sets of perforations 102 and 104 in FIG. 1) is in contact with and disposed along an external surface of the protective layer. The perforated layer is disposed between the protective layer and the headphone cover and helps to mitigate wind noise.

With advancements in technology, microphones are becoming smaller. As an example, MEMS microphones are smaller than ECMs. MEMS microphone sensors can have dimensions of 4 mm×3 mm×1 mm. MEMS microphone sensors offer some advantages compared to ECMs in terms of performance, reliability, and manufacturability. MEMS microphone sensors have higher performance density as compared to ECMs meaning that MEMS microphone sensors may more effectively cancel noise. MEMS microphone sensors are less temperature sensitive. MEMS microphone sensors have a lower vibration sensitivity. MEMS microphone sensors have a more uniform part-to-part frequency response than ECMs meaning that products using MEMS microphone sensors are expected to have more stable performance. Despite these advantages, MEMS microphone sensors are fragile and sensitive to dirt, debris, and liquid. To provide additional protection to a microphone sensor, aspects of the present disclosure provide a multi-layer protection for the microphone sensor. While some aspects are described with reference to a MEMS microphone sensor, the multi-layer protective structure described herein is applicable to provide additional protection for any type of microphone or any sensor in which it is desirable to prevent particle or moisture ingress.

In some examples, the multi-layer protection has two layers of protection. The dual-layer includes a first, outer protective layer disposed at an outer end of a first cavity (for example, 202 and 204) and a second, inner protective layer disposed between an inner end of the first cavity and the microphone element.

The first, outer protective layer and the second, inner protective layer may have different acoustic impedances. In one example, the acoustic impedance of the first, outer layer is lower than an acoustic impedance of the second, inner layer.

The first, outer protective layer has a larger percent open area as compared to the second, inner protective layer. The first, outer layer may be substantially acoustically open and made of a material having an average larger pore size than the material of the second, inner layer. Therefore, the first, outer layer may have a lower acoustic impedance, or fewer rayls than the second, inner layer. Having a substantially acoustically open outer layer allows more acoustic energy into the device; however, the acoustically open layer may allow passage of dust, liquid, and debris, which may damage a microphone sensor.

The second, inner layer may be more acoustically closed as compared to the first, outer protective layer. The average smaller pore size of the second, inner layer may protect the microphone from particles and/or liquid that may have breached the first, outer layer. Thus, the second, inner layer enhances protection of the microphone sensor. Due to the smaller pore size, the second, inner layer is more acoustically closed compared to the first, outer protective layer. As will be illustrated in, for example, FIGS. 4 and 6-8, because the second, inner protective layer is coupled to a smaller cavity (as compared to the acoustic volume in front of the microphone elements), devices may tolerate a protective layer having a higher acoustic impedance located closer to the microphone sensor.

The acoustic load behind the second, inner protective layer, which is comprised of air trapped between the second, inner protective layer and the microphone element, is a small volume that is stiff and has a higher acoustic impedance. The volume between the first, outer protective layer and the microphone element is larger and has less stiffness than the smaller volume between the second, inner protective layer and the microphone element. Therefore, the volume behind the first, outer protective layer has a lower impedance. Accordingly, the second inner protective layer can utilize a high impedance material to match the high impedance load behind it, while the first outer protective layer may have less impedance to match the lower impedance of the larger cavity behind it.

According to aspects, one or both of the first, outer layer and the second, inner layer are coated with a hydrophobic or super hydrophobic coating to mitigate liquids from reaching and potentially damaging the microphone sensor.

One or both of the first, outer layer and the second, inner layer may be a woven, mesh material. The pore size of the first, outer layer may be larger than a pore size of the second, inner layer. According to an aspect, one or both of the layers may be a micro-perforated plastic or any material that allows passage of acoustic energy while providing a barrier for particle and/or liquid ingress. In an example, the first and second layers may be different materials.

Microphone sensors are housed inside a microphone element (which may be referred to as a microphone assembly). The microphone element that houses the microphone sensor can have a sound opening through the top cover of the microphone element, referred to as a top-port microphone element, or through the bottom substrate of the microphone element, referred to as a bottom-port microphone element. In an aspect, the bottom surface of the microphone element is a substrate, a printed circuit board (PBC), or a flexible circuit board. The dual-layer protection described herein is applicable to top-port and bottom-port microphone elements, assemblies using a MEMS microphone sensor, or any other type of microphone element in a device that captures sound.

Figure 3:
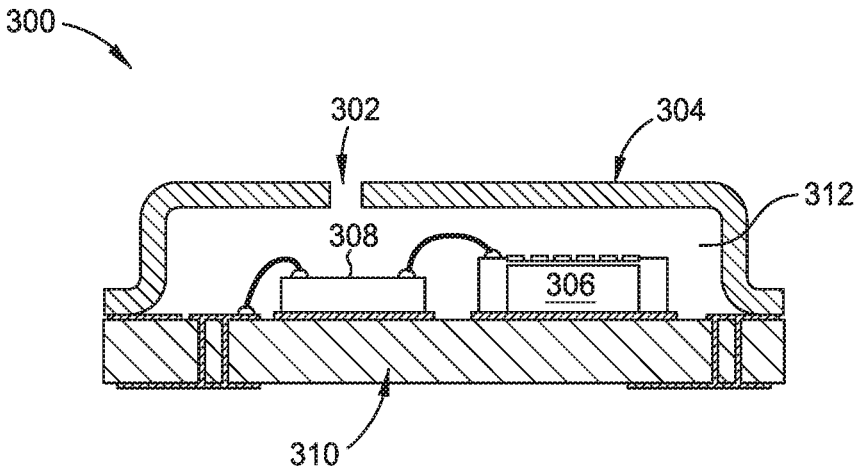
FIG. 3 illustrates an example of a top-port microphone element.

FIG. 3 illustrates an example of a top-port microphone element 300. A sound opening 302 extends through a cover plate or top cover 304 of the microphone element. The microphone sensor 306 is located within the microphone element 300. In the case that the microphone sensor 306 is a MEMS device, the microphone sensor 306 is coupled to an application-specific integrated circuit (ASIC) 308. The microphone sensor 306 and the ASIC 308 are disposed on a substrate 310 such as a PCB substrate or a flexible circuit board. In an aspect, the flexible circuit board is free of wires (leads). The microphone sensor 306 is located in a microphone cavity 312 defined by the cover plate 304 and the substrate 310.

Figure 4:
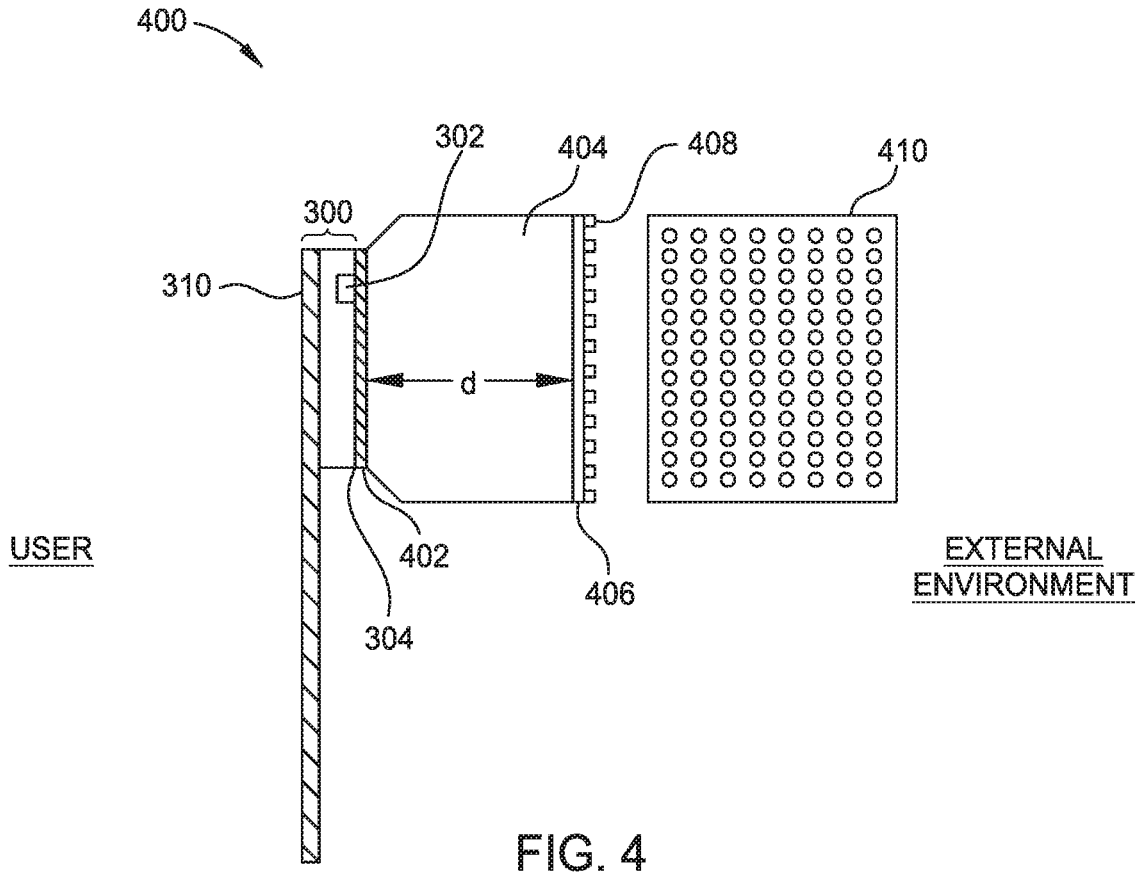
FIG. 4 illustrates an example of multi-layer protection of a top-port microphone element.

FIG. 4 illustrates an example of dual-layer protection of a top-port microphone element 400 in accordance with aspects of the present disclosure. The microphone element 300 may be the microphone element illustrated in FIG. 3. The microphone element includes a sound opening 302 extending through a cover plate 304 of the microphone element 300. The microphone sensor (not illustrated in FIG. 4) is coupled to the substrate or circuit board 310 of the microphone element 300.

An inner, protective layer 402 of the microphone element is positioned on a cover plate 304 of the microphone element 300. A first surface of the inner, protective layer 402 may be adhered or press-fit to the cover plate 304 of the microphone element. A second surface of the inner protective layer, opposite the first surface, is coupled to an enclosure defining a cavity 404. The side of the cavity 404 opposite the microphone element 300 is coupled to an outer, protective layer 406. The outer, protective layer may be adhered or press-fit to the side of the cavity opposite the microphone element. In an aspect, the distance d between the inner protective layer 402 and the outer protective layer 406 is approximately 2 mm. According to one non-limiting example, the dimensions of the cavity 404 in a headphone may be approximately 1 mm by 4 mm by 1-2 mm.

In certain aspects, an outer portion of the outer, protective layer is coupled to an outer perforated layer 408. A top view of the perforated layer 408 is illustrated at 410. The outer perforated layer 408 (and top view 410) may be one of the set of perforations 102 or 104 of the headphone cover 100 illustrated in FIG. 1. In an example, the perforated layer 408 is made of plastic or any semi-rigid material. In an example the perforated layer 408 are made of any stiff but not inflexible material.

The cavity 404 mechanically couples the acoustic volume of the microphone cavity 312 with the outer, protective layer 406 in a manner that minimizes leakage. A sealed structure defines the cavity 404. In one example, the cavity 404 may have a substantially conical shape. In an example, the cavity 404 is narrower on an internal side, closer to the microphone element 300 and wider on an external side, closer to the optional perforated layer 408 and the outside environment. Therefore, the first, outer protective layer and the second, inner protective layer may have different shapes and sizes. This design configuration maximizes the open area in front of the microphone cavity (maximizes the area in cavity 404) to maximize acoustic energy transmission.

Figure 5:
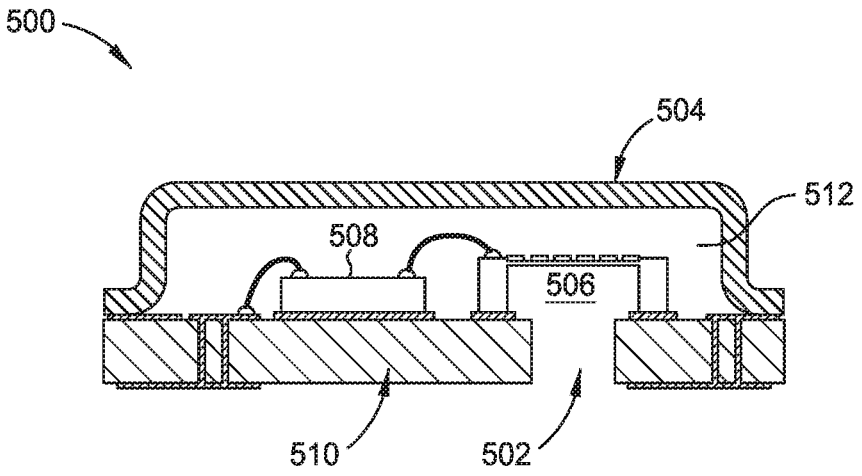
FIG. 5 illustrates an example of a bottom-port microphone element.

FIG. 5 illustrates an example of a bottom-port microphone element 500. The bottom-port microphone element includes a cover plate or top cover 504. A microphone sensor 506 is located within a microphone cavity 512 defined by a cover plate 504 and a substrate 510. A sound opening 502 extends through the substrate 510. As described with reference to FIG. 3, the microphone sensor 506 may be a MEMS microphone that is coupled to an ASIC 508. The microphone sensor 506 and the ASIC 508 are disposed on the substrate 510. The substrate 510 may be a PCB substrate or a flexible circuit board. In an aspect, the flexible circuit board is free of wires (leads).

Figure 6:
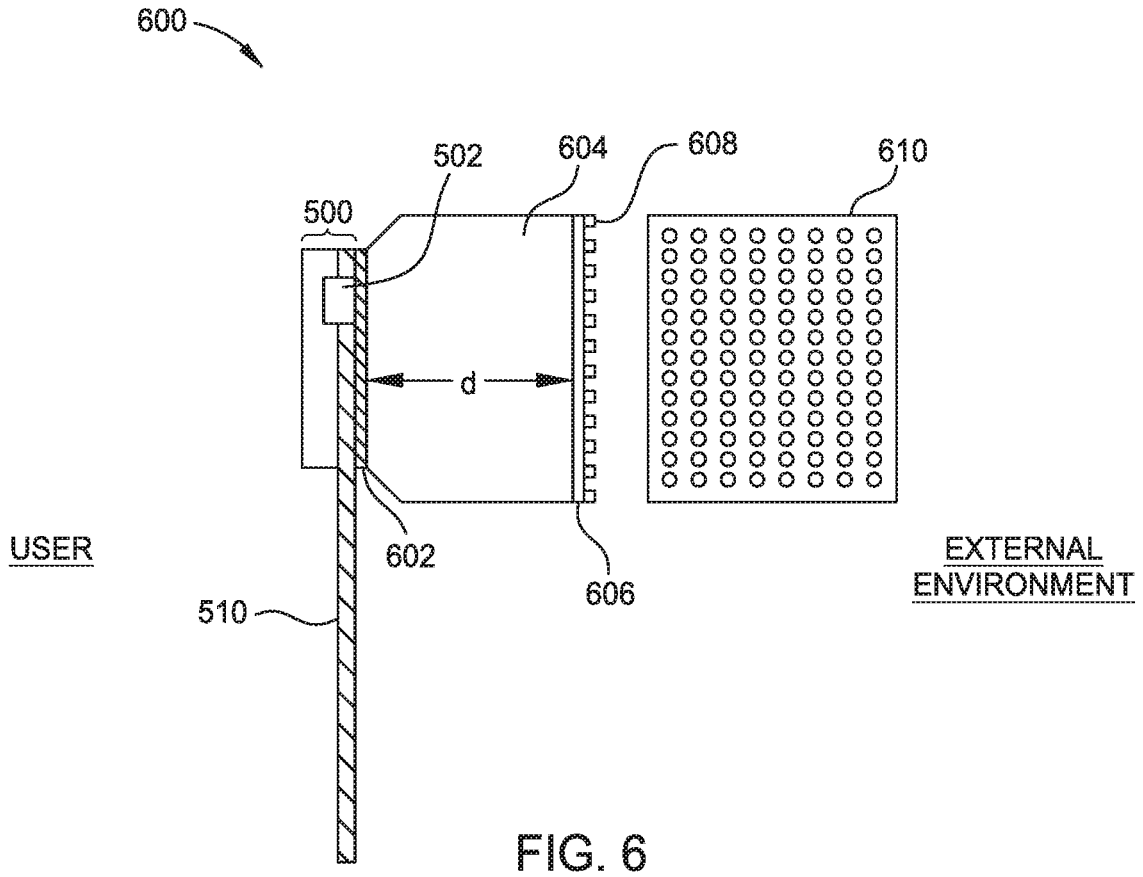
FIG. 6 illustrates an example of multi-layer protection of a bottom-port microphone element.

FIG. 6 illustrates an example of dual-layer protection of a bottom-port microphone element 600 in accordance with aspects of the present disclosure. The microphone element 500 may be the microphone element illustrated in FIG. 5. The microphone element includes a sound opening 502 extending through the substrate 510 of the microphone element. The microphone sensor (not illustrated in FIG. 6) is coupled to the substrate 510 of the microphone element 500.

The inner, protective layer 602 of the microphone element is positioned between an inner side of a cavity 604 and the substrate 510. A first surface of an inner, protective layer 602 may be adhered or press-fit to the substrate 510 of the microphone element 500. A second surface of the inner protective layer, opposite the first surface, is coupled to an enclosure defining a cavity 604. The side of the cavity 604 opposite the microphone element 500 is coupled to an outer, protective layer 606. The outer, protective layer 606 may be adhered or press-fit to the side of the cavity opposite the microphone element. In certain aspects, an outer portion of the outer, protective layer is coupled to an outer perforated layer 608. A top view of the perforated layer 608 is illustrated at 610. The outer perforated layer 608 (and top view 610) may be one of the set of perforations 102 or 104 of the headphone cover 100 illustrated in FIG. 1. In an example, the perforated layer 608 is made of plastic. In an example, the perforated layer 608 is made of any stiff but not inflexible material.

The cavity 604 is similar in size, shape, and structure to the cavity 404 in FIG. 4. As described above with reference to the cavity 404 in FIG. 4, the cavity 604 in FIG. 6 mechanically couples the acoustic volume of the microphone cavity 512 with an outer, protective layer 606 in an effort to minimize leakage. A sealed structure defines the cavity 604. In one example, the cavity 604 may have a substantially conical shape. In an example, the cavity 604 has a smaller opening on an internal side, closer to the microphone element 500 and has a larger opening on an external side, closer to the optional perforated layer 608 and the outside environment. Therefore, the first, outer protective layer and the second, inner protective layer may have different shapes and sizes. This design configuration maximizes the open area in front of the microphone cavity (maximizes the area in cavity 604) for acoustic energy transmission.

According to certain aspects, a microphone assembly may include any number of microphone elements 300 or 500. For example, a microphone assembly may include an array of microphone elements, each microphone element including a microphone sensor. The microphone elements may be an array of top-port microphone elements 300 or an array of bottom-port microphone elements 500.

Figure 7:
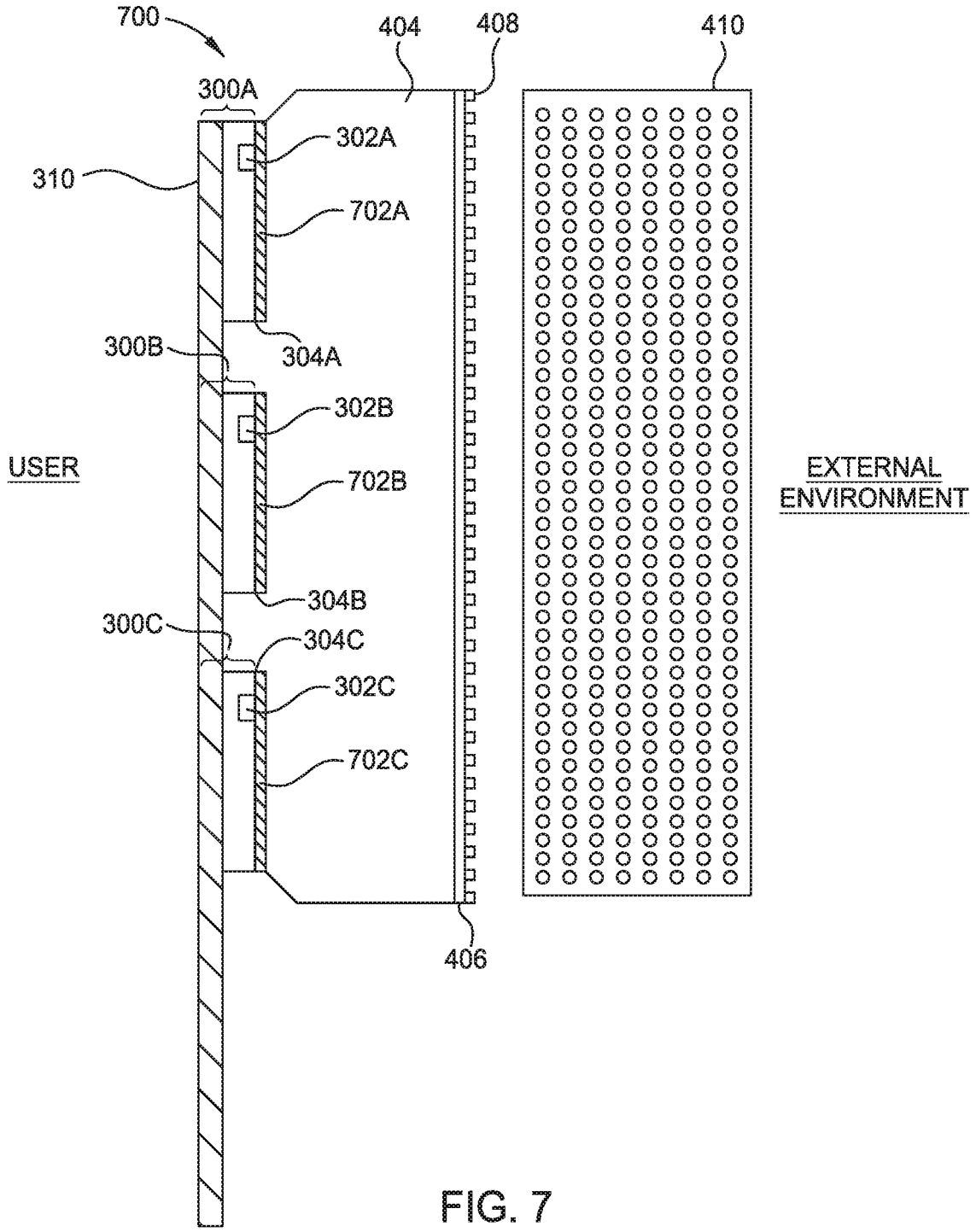
FIG. 7 illustrates an example of a multi-layer protection for an array of top-port microphone elements.

FIG. 7 illustrates an array of top-port microphone elements having a dual-layer protection 700. FIG. 7 includes some similar components, having similar properties and reference numerals, as the dual-layer protection of a top-port microphone element as illustrated in FIG. 4.

In one example, the top-port microphone element 700 includes an array of microphone elements 300A-300C. The array of microphone elements 300A-300C is coupled to the substrate or PCB 310. The inner, protective layers 702A-702C are positioned on a cover plate 304A-304C of the microphone elements 300A-300C. A second surface of the inner protective layer 702A-702C, opposite the first surface, is coupled to the enclosure defining a cavity 404. The side of the cavity 404 opposite the microphone elements 300A-300C is coupled to an outer, protective layer 406.

Figure 8:
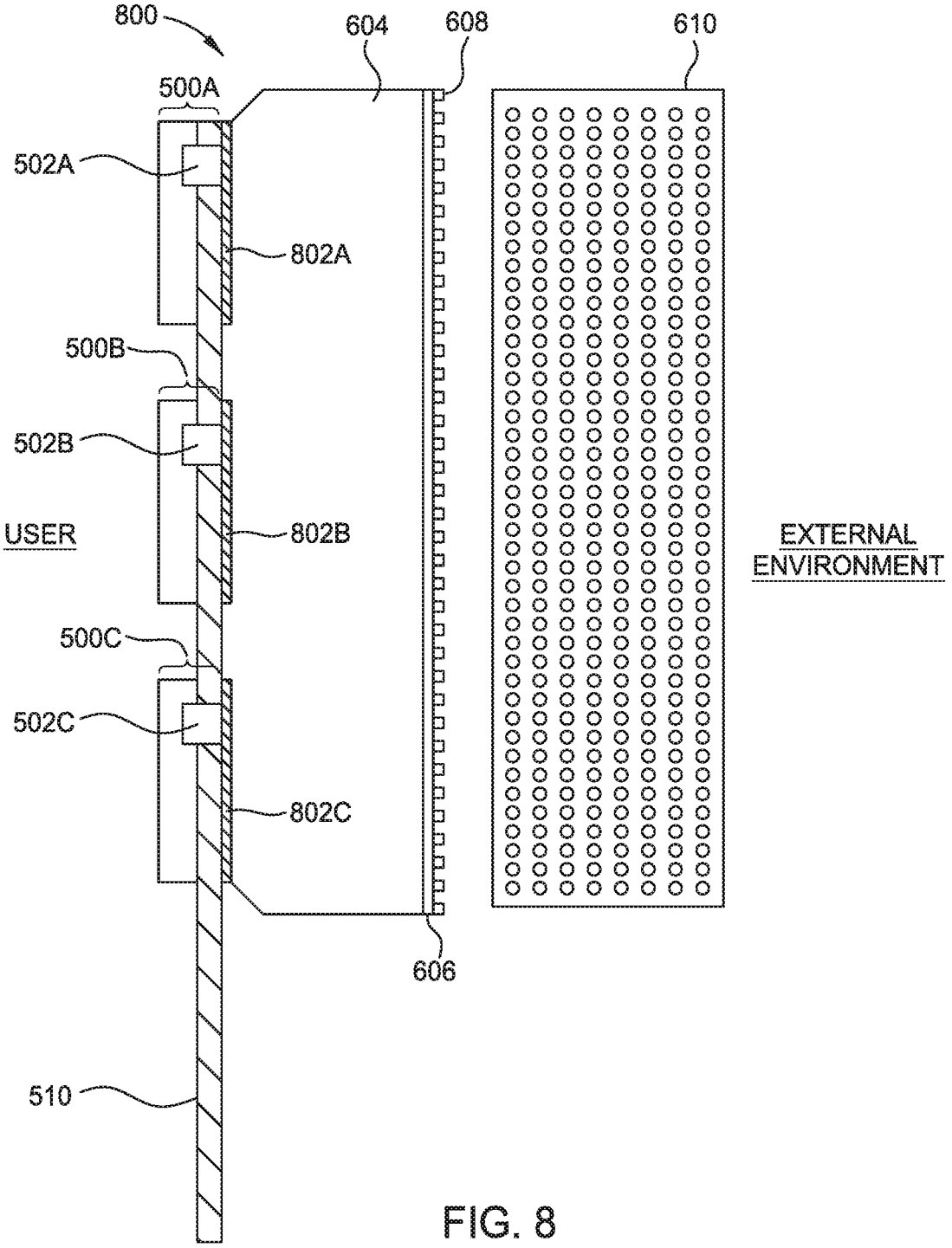
FIG. 8 illustrates an example of a multi-layer protection for an array of bottom-port microphone elements.

FIG. 8 illustrates an array of bottom-port microphone elements have a dual layer protection 800. FIG. 8 includes some similar components, having similar properties and reference numerals, as the dual-layer protection of a bottom-port microphone element as illustrated in FIG. 6.

In one example, the bottom-port microphone assembly 800 includes an array of microphone elements 500A-500C. The array of microphone elements 500A-500C is coupled to the substrate or PCB 510. The inner, protective layers 802A-802C are positioned between an interior side of the cavity 604 and the substrate 510. A second surface of the inner protective layer, opposite the first surface, is coupled to an enclosure defining a cavity 604. The side of the cavity 604 opposite the microphone elements 500A-500C is coupled to an outer, protective layer 606.

Therefore, an acoustic device comprising multiple microphone elements in a single microphone cavity are protected by a first protective layer disposed at an outer end of the cavity (404 and 604) and a second protective layer disposed between an inner end of the first cavity and each microphone element in the array of microphone elements. The first and second protective layers for an array of microphones are adhered or press-fit to one of a cover plate of the microphone element or a circuit board or substrate in contact with the microphone cavity. The properties of the first and second protective layers for an array of microphone elements are similar to the properties of the first and second protective layers described above for a microphone cavity including a single microphone sensor.

References to a headphone are for exemplary purposes only. The multi-layer protection for one or more microphone elements described herein is equally applicable to other form factors. As noted above, the multi-layer protection is used on any device that captures sound including but not limited to hearing assistance devices, built-in devices for a home, and telecom systems.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. An apparatus comprising:

an enclosure defining a first cavity, the first cavity defined by at least four sides of the enclosure, the first cavity comprising an outer end having a first length and an inner end, wherein the outer end is closer to an external environment than the inner end;

a microphone element coupled to the first cavity, the microphone element comprising a microphone sensor and a cover plate, the microphone sensor being disposed in a microphone cavity, wherein the cover plate defines at least a portion of the microphone cavity, and wherein the microphone cavity is smaller in size than the first cavity;

a first outer protective layer disposed at the outer end of the first cavity on a first interior surface of a first side of the enclosure, wherein the first outer protective layer has a second length equal to the first length of the outer end of the first cavity; and a second inner protective layer disposed between the inner end of the first cavity and the microphone element, the second inner protective layer being disposed adjacent to a second surface of the enclosure opposite the first surface, wherein the second inner protective layer is spaced from the first outer protective layer by a width of the first cavity.

2. The apparatus of claim 1, wherein the first outer protective layer is associated with a first acoustic impedance and the second inner protective layer is associated with a second acoustic impedance, wherein the first and second acoustic impedances are different.

3. The apparatus of claim 1, wherein an acoustic impedance associated with the first outer protective layer is lower than an acoustic impedance of the second inner protective layer.

4. The apparatus of claim 1, wherein an average pore size of the first outer protective layer is larger than an average pore size of the second inner protective layer.

5. The apparatus of claim 1, wherein an acoustic impedance in rayls associated with the first outer protective layer is lower than an acoustic impedance in rayls associated with the second inner protective layer.

6. The apparatus of claim 1, wherein:

the microphone element comprises a top-port microphone element; and the second inner protective layer is in contact with the cover plate of the microphone element.

7. The apparatus of claim 1, wherein:

the microphone element comprises a bottom-port microphone element; and the second inner protective layer is disposed between, and in contact with, the inner end of the first cavity and a substrate of the bottom-port microphone element.

8. The apparatus of claim 7, wherein:

the second inner protective layer is one of press-fit or adhered to the substrate.

9. The apparatus of claim 1, further comprising:

a perforated layer in contact with and disposed along an external surface of the first outer protective layer.

10. The apparatus of claim 1, wherein the first outer protective layer and the second inner protective layer comprise different shapes and sizes.

11. The apparatus of claim 1, wherein the first outer protective layer covers a larger surface than the second inner protective layer.

12. The apparatus of claim 1, wherein at least one of the first outer protective layer and the second inner protective layer comprises a hydrophobic coating.

13. The apparatus of claim 1, wherein the apparatus comprises one of an in-ear headphone, an around-ear headphone, on-ear headphone, or a speaker.

14. An apparatus comprising:

an enclosure defining a first cavity, the first cavity defined by at least four sides of the enclosure, the first cavity comprising an outer end having a first length and an inner end, wherein the outer end is closer to an external environment than the inner end;

a microphone assembly coupled to the first cavity, the microphone assembly comprising an array of microphone elements, wherein each microphone element comprises a microphone sensor and a cover plate, the microphone sensor being disposed in a microphone cavity, wherein the cover plate defines at least a portion of the microphone cavity, and wherein the microphone cavity is smaller in size than the first cavity;

a first protective layer disposed at the outer end of the first cavity on a first interior surface of a first side of the enclosure, wherein the first protective layer has a second length equal to the first length of the outer end of the first cavity; and a second protective layer disposed between an inner end of the first cavity and each microphone sensor in the array of microphone elements, the second protective layer being disposed adjacent to a second surface of the enclosure opposite the first surface, wherein the second protective layer is spaced from the first protective layer by a width of the first cavity, and wherein the second protective layer is one of adhered or press-fit to one of the cover plate of a microphone element of the microphone assembly and a circuit board in contact with the array of microphone elements.

15. The apparatus of claim 14, wherein the first protective layer is associated with a first acoustic impedance and the second protective layer is associated with a second acoustic impedance, wherein the first and second acoustic impedances are different.

16. The apparatus of claim 14, wherein the first protective layer is associated with a larger percent open area than the second protective layer.

17. The apparatus of claim 14, wherein the array of microphone elements comprises an array of Micro Electro-Mechanical System (MEMS) microphone sensors.

18. The apparatus of claim 14, wherein the outer end of the first cavity covers a larger surface area than the inner end of the first cavity.

19. The apparatus of claim 14, wherein at least one of the first protective layer and the second protective layer comprises a material having hydrophobic properties.

* * * * *